US005199609A

United States Patent [19]

Ash, Jr.

[11] Patent Number: 5,199,609

[45] Date of Patent: Apr. 6, 1993

[54] PORTABLE DISPENSING SYSTEM

[76] Inventor: William O. Ash, Jr., 2537 S. Gessner, Ste. 216, Houston, Tex. 77063

[21] Appl. No.: 758,898

[22] Filed: Sep. 11, 1991

[51] Int. Cl.[5] ..... B65D 35/22

[52] U.S. Cl. ..... 222/94; 222/105; 222/325; 222/396; 222/399; 222/400.7; 141/48; 141/114

[58] Field of Search ..... 222/94, 105, 131, 175, 222/183, 325, 386.5, 394, 399, 400.7, 401, 402.1, 396, 529, 530; 224/148; 141/21, 63, 64, 48, 114

[56] References Cited

U.S. PATENT DOCUMENTS

| | | | |
|---|---|---|---|
| 2,732,977 | 1/1956 | Charpiat | 222/399 |
| 2,777,610 | 1/1957 | Fox et al. | 222/530 |
| 3,147,889 | 9/1964 | Dolgin | 222/175 |
| 3,286,884 | 11/1966 | Long, Jr. | 222/399 |
| 3,419,193 | 12/1968 | Stewart et al. | 222/183 |
| 3,768,706 | 10/1973 | Hill | 272/396 |
| 3,866,626 | 2/1975 | Johnston | 141/21 |
| 4,187,959 | 2/1980 | Pelton | 222/94 |
| 4,869,402 | 9/1989 | Ash, Jr. | 222/131 |
| 4,921,143 | 5/1990 | Billet | 222/175 |

*Primary Examiner*—Andres Kashnikow
*Assistant Examiner*—Philippe Derakshani
*Attorney, Agent, or Firm*—Kenneth A. Roddy

[57] ABSTRACT

A portable beverage dispenser system is housed within a rigid back pack transported on the back of a vendor. A beverage dispensing container, dispensing hose, and a pressurized gas container is housed within the back pack. The beverage dispensing container has a rigid wall surrounded by a flexible thermally insulating and cushioning jacket and an access opening at the top end of the dispensing container receives a removable flexible liner. A releasably locked closure lid is removably mounted within the access opening and has a gas fill valve and liquid fill and dispensing valve thereon with passages extending through the closure. The flexible liner is inserted into and withdrawn from the dispensing container in a collapsed condition and substantially conforms to the shape of the interior of the container in an installed liquid filled condition. The liner has an open end releasably engaged on the lid closure and forms a fluid pressure sealed envelope for containing the liquid beverage and the pressurized gas. The pressurized gas container is connected to the gas fill valve to maintain pressurization of the liquid in the dispensing container, and the dispensing hose is connected at one end to the liquid fill and dispensing valve and has a manually operable dispensing valve at the other end for dispensing the pressurized liquid.

13 Claims, 3 Drawing Sheets

PORTABLE DISPENSING SYSTEM

BACKGROUND OF THE INVENTION

1. Field of the Invention

This invention relates generally to beverage dispensers of the type adapted to be carried on the back of a vendor, and more particularly to a portable back pack beverage dispensing system including a dispensing tank having an insulated flexible jacket and a gas pressurizing member connected to the tank for maintaining gas pressure on the beverage.

2. Brief Description of the Prior Art

Portable beverage dispensers adapted to be transported on the back of a vendor by use of a body harness are known, as disclosed by way of example, in Charpiat U.S. Pat. No. 2,684,787 and Grafia U.S. Pat. No. 2,808,965 et al. Such portable dispensers include a tank made of rigid material enclosing a liquid storing chamber from which the beverage is dispensed and into which the beverage is charged through a reloading valve connected to the bottom of the tank. The beverage is accordingly dispensed under a gravitational pressure head. To assist in dispensing of the beverage, particularly when the liquid within the tank becomes depleted, the tank chamber may be internally pressurized with air by means of a pump as disclosed, for example, in Dolgin U.S. Pat. No. 3,147,889.

Motsenbocker, U.S. Pat. No. 4,420,097 discloses a portable liquid dispenser having an insulated carring case which contains a first flexible container and a second flexible container positioned therein. A freezable liquid is contained in the second container and the liquid to be dispensed is contained in the first container in contact with the surface of the container with the frozen liquid to cool the liquid to be dispensed. The liquid is dispensed under gravitational pressure.

Boxer et al, U.S. Pat. No. 4,526,298 discloses a flexible water bag or pouch which may be insulated that is carried on shoulder straps similar to a back pack. The liquid is dispensed by a squeeze type dispensing nozzle.

Ash, U.S. Pat. No. 4,896,402 discloses a rigid dispenser tank with an outer insulated jacket and an interior flexible bladder connected to a hand pump. Liquid to be dispensed is stored in the rigid dispenser tank and the flexible bladder is inflated to maintain the liquid under pressure.

Sims, U.S. Pat. No. 3,662,929 discloses a non-insulated rigid container with interior flexible bladder connected to a source of fluid pressure. A fluid substance to be dispensed is stored in the rigid container and the flexible bladder is inflated to discharge the fluid substance under pressure.

Uhlig, U.S. Pat. No. 4,098,434 discloses a non-insulated fluid product dispenser having first container and a second flexible container positioned inside the first container. Fluid to be dispensed is contained in one of the containers and fluid under pressure is introduced into the other container to urge the product fluid through a dispensing nozzle or opening.

Cornelius, U.S. Pat. No. 2,513,455 discloses a non-insulated rigid dispenser tank with an interior flexible bladder connected to a gas container. Fluid to be dispensed is stored in the rigid dispenser tank. The gas fed to the bladder condenses at the pressure and temperature at which the fluid in the container is to be discharged.

Shy, U.S. Pat. No. 4,300,705 discloses a compressed vacuum insulated bottle which operates by siphonage and compression of an elastic pouch in the top of the bottle stopper to siphon boiling water into the elastic pouch and then to drain off the boiling water by compression.

Beverage dispensers using internal pressurization of the beverage containing tank promote deterioration of internal tank surface so as to limit tank construction to expensive materials, such as stainless steel. Internal pressurization of the beverage tank has also been known to cause, to some extent, degradation in the quality of the beverage, such as loss of carbonation. For obvious health reasons, metal beverage tanks also must be repeatedly and thoroughly cleaned.

The present invention is distinguished over the prior art in general, and these patents in particular by a portable beverage dispenser system housed within a rigid back pack and transported on the back of a vendor. A beverage dispensing container, dispensing hose, and a pressurized gas container is housed within the back pack. The beverage dispensing container has a rigid wall surrounded by a flexible thermally insulating and cushioning jacket and an access opening at the top end of the dispensing container receives a removable flexible liner. A releasably locked closure lid is removably mounted within the access opening and has a gas fill valve and liquid fill and dispensing valve thereon with passages extending through the closure. The flexible liner is inserted into and withdrawn from the dispensing container in a collapsed condition and substantially conforms to the shape of the interior of the container in an installed liquid filled condition. The liner has an open end releasably engaged on the lid closure and forms a fluid pressure sealed envelope for containing the liquid beverage and the pressurized gas. The pressurized gas container is connected to the gas fill valve to maintain pressurization of the liquid in the dispensing container, and the dispensing hose is connected at one end to the liquid fill and dispensing valve and has a manually operable dispensing valve at the other end for dispensing the pressurized liquid.

SUMMARY OF THE INVENTION

It is therefore an object of the present invention to provide a portable beverage dispensing system which is self contained and suitable to be carried on the back of a vendor.

It is another object of this invention to provide a portable beverage dispensing system which will allow beverages to be served at optimum temperatures, mixtures, and carbonation levels and in a sanitary manner.

Another object of this invention is to provide a portable beverage dispensing system which is suitable for containing and dispersing a wide variety of liquid beverages, such as soft drinks, beer, coffee, hot chocolate, soup, fruit drinks, wine coolers, and mixed drinks.

Another object of this invention is to provide a portable beverage dispensing system which greatly reduce the time-consuming cleaning, disinfecting, and maintenance operations associated with conventional beverage dispensers.

Another object of this invention is to provide a portable beverage dispensing system having a liner within a beverage dispensing tank which will eliminate deterioration of the internal tank surface and allow the tank to be constructed of inexpensive materials.

A further object of this invention is to provide a portable beverage dispensing system having a beverage dispensing tank that is covered by a protective shock absorbing thermally insulating jacket in contact with the tank exterior and which has an outer layer of flexible material.

A still further object of this invention is to provide a portable beverage dispensing system which is aesthetically pleasing, simple in construction, economical to manufacture, and rugged and durable in use.

Other objects of the invention will become apparent from time to time throughout the specification and claims as hereinafter related.

The above noted objects and other objects of the invention are accomplished by a portable beverage dispenser system housed within a rigid back pack and transported on the back of a vendor. A beverage dispensing container, dispensing hose, and a pressurized gas container is housed within the back pack. The beverage dispensing container has a rigid wall surrounded by a flexible thermally insulating and cushioning jacket and an access opening at the top end of the dispensing container receives a removable flexible liner. A releasably locked closure lid is removably mounted within the access opening and has a gas fill valve and liquid fill and dispensing valve thereon with passages extending through the closure. The flexible liner is inserted into and withdrawn from the dispensing container in a collapsed condition and substantially conforms to the shape of the interior of the container in an installed liquid filled condition. The liner has an open end releasably engaged on the lid closure and forms a fluid pressure sealed envelope for containing the liquid beverage and the pressurized gas. The pressurized gas container is connected to the gas fill valve to maintain pressurization of the liquid in the dispensing container, and the dispensing hose is connected at one end to the liquid fill and dispensing valve and has a manually operable dispensing valve at the other end for dispensing the pressurized liquid.

DESCRIPTION OF THE PREFERRED EMBODIMENT

Figure 2:
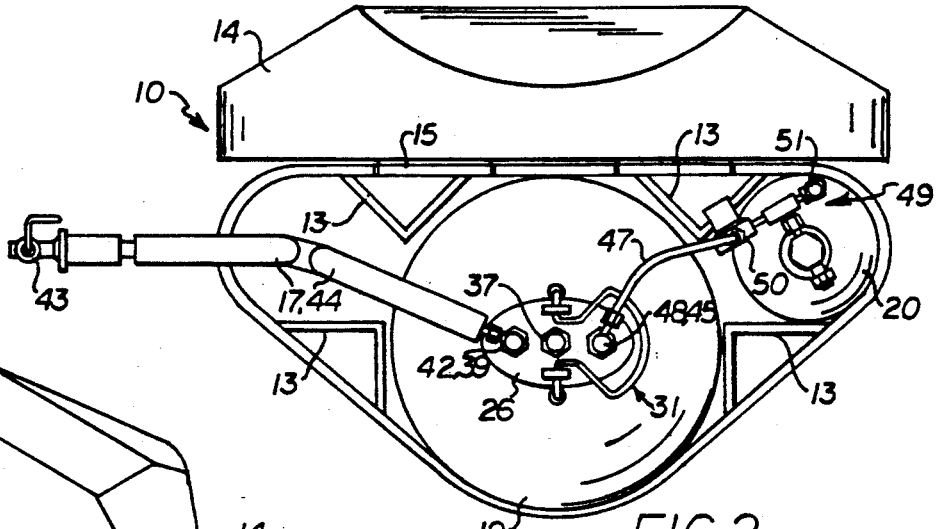
FIG. 2 is a top plan view of the back pack with the lid open and showing the beverage dispensing apparatus contained therein.
Figure 1:
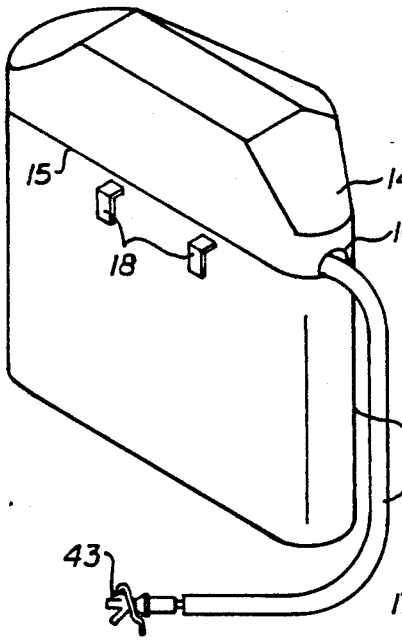
FIG. 1 is an isometric view of a back pack containing beverage dispensing apparatus in accordance with the present invention.
Figure 3:
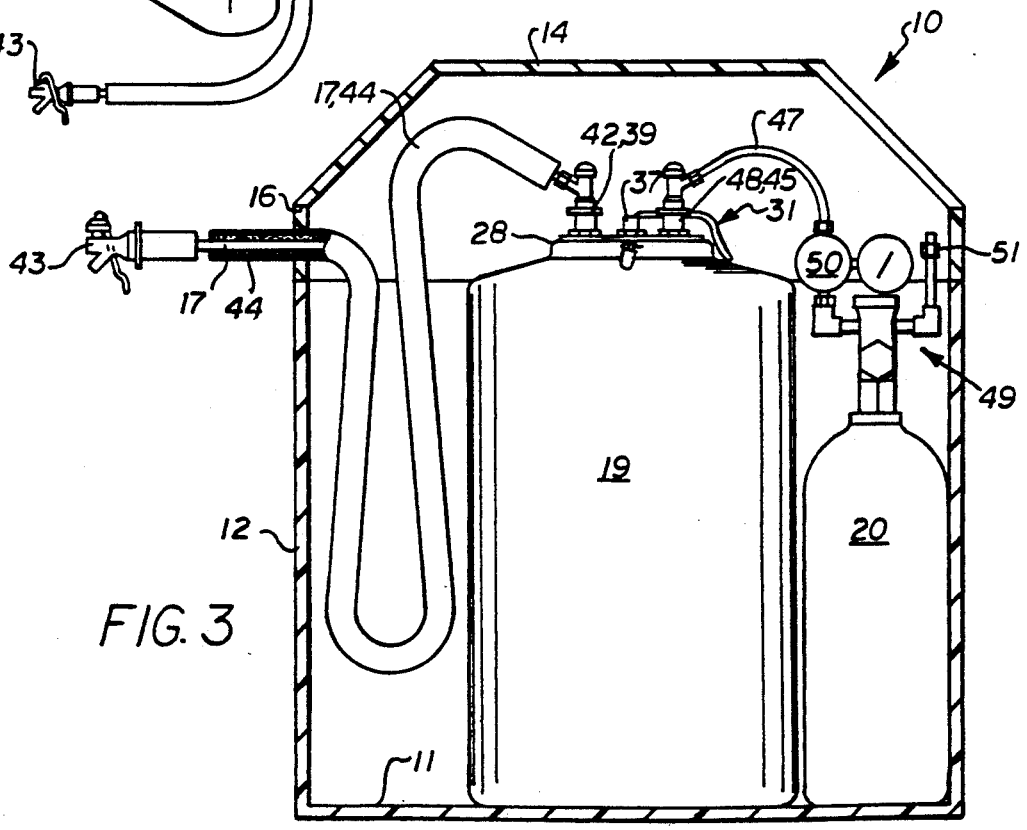
FIG. 3 is a longitudinal cross section through the back pack showing the beverage dispensing apparatus contained therein.

Referring to the drawings by numerals of reference, there is shown in FIGS. 1, 2, and 3, a back pack 10 which houses a portable beverage dispensing system. The preferred back pack 10 is formed of durable molded plastic material and has a bottom wall 11 and a side wall 12 of generally triangular transverse cross section defining an interior compartment which receives and carries a pair of cylindrical tank members and dispensing materials as described hereinafter. As seen in FIG. 2, the interior of the back pack 10 may be formed with a plurality of inwardly projecting divider members 13 which define compartments and facilitate a close fit for the cylindrical tanks. A lid portion 14 is hinged to the upper portion of the back pack 10 by a hinge 15 and forms the top of the back pack. An aperture 16 is formed through one side of the lid portion 14 such that a dispensing hose 17 may be passed therethrough when the lid is closed. The exterior of the back pack 10 is provided with a pair of hooks 18 or other suitable connectors for releasably attaching the back pack onto a frame and body harness (not shown) which is worn by a vendor.

The dispensing system carried in the back pack 10 includes a beverage dispensing tank 19, dispensing hose 17, and a pressurized gas supply tank 20. It should be understood that in some cases a hand pump (not shown) may be used in place of the pressurized gas supply tank. Such a hand pump is described in applicant's U.S. Pat. No. 4,869,402.

Figure 4:
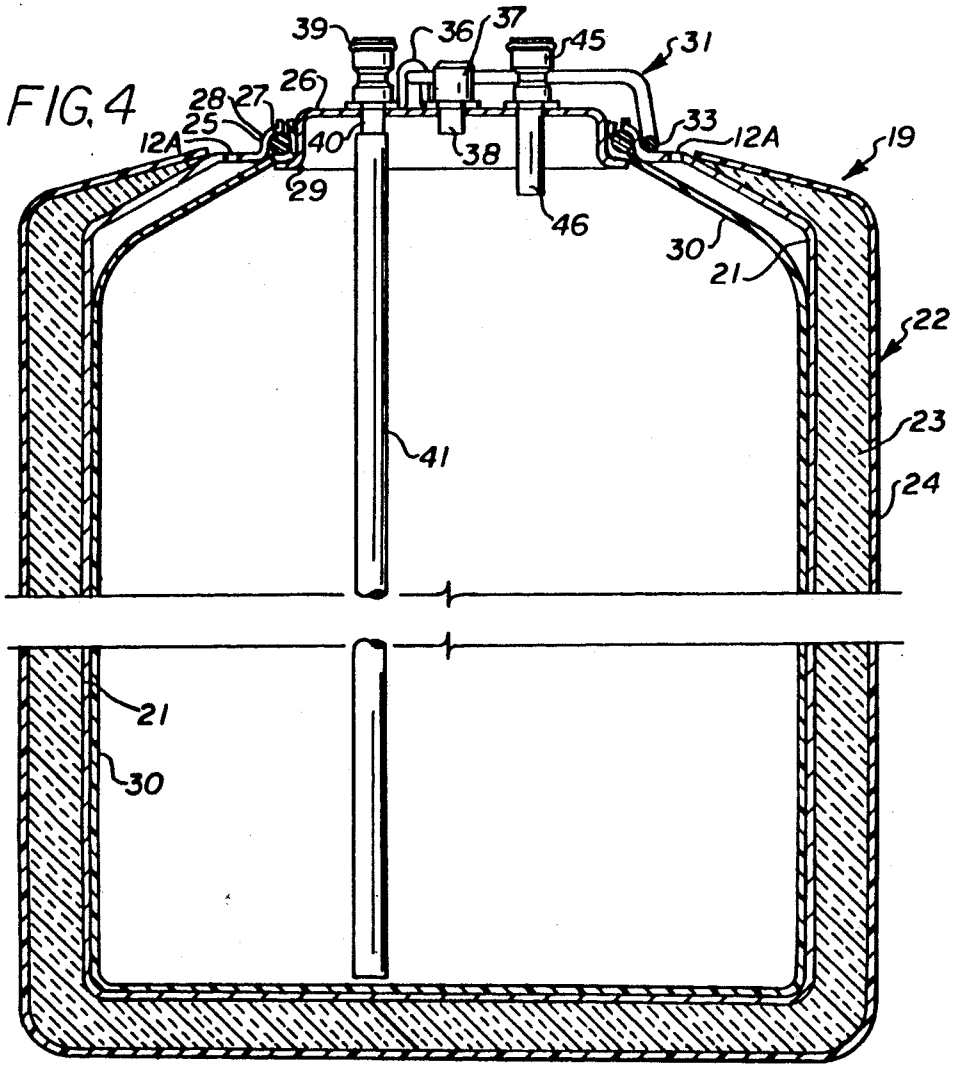
FIG. 4 is a longitudinal cross section through the beverage dispensing container of the present invention.

As more clearly shown in FIG. 4, the beverage dispensing tank 19 has a rigid side wall 21 made of thin gauge material such as stainless steel or aluminum protectively enclosed by a shock absorbing insulator jacket 22. The jacket 22 is formed of a dense layer of shock absorbent elastomeric material 23 such as foam plastic or foam rubber in contact with the tank exterior and has an outer layer or skin 24 of flexible material such as flexible plastic or rubber.

A generally oval-shaped access opening 25 is formed in the top of the beverage tank 19 and the access opening is sealingly closed by an oval-shaped lid closure member 26 on which an annular sealing ring 27 is carried. The opening 25 has a surrounding flange 28 semicircular in cross section, and the lid closure 26 has an opposite opposed annular semi-circular flange 29. The flanges 28 and 29 cooperate with the sealing ring 27 to form a fluid tight seal at the top of the beverage tank 19.

Figure 5:
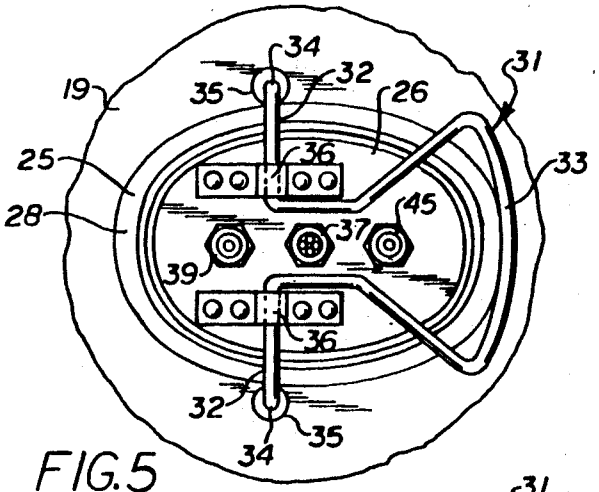
FIG. 5 is a top plan view of the releasably locked closure lid is removably mounted within the access opening of the beverage dispensing container.
Figure 6:
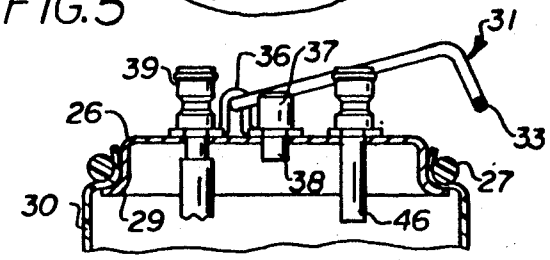
FIG. 6 is a cross section through the releasably locked closure lid showing the open end of a liner member attached thereto by an annular seal ring.
Figure 8:
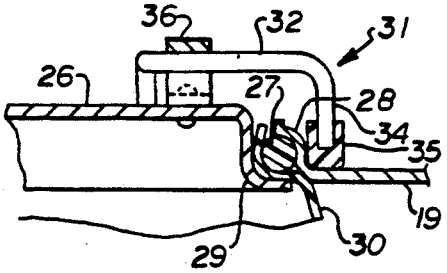
FIG. 8 is a partial cross section through the lid closure showing a portion of the releasable lock mechanism.

A flexible bag liner 30 having an open top end releasably attached to the lid closure 26 fits into the interior of the tank 19 and conforms to the interior of the tank in a liquid filled condition (explained hereinafter) The preferred bag liner 30 is made of a gas and liquid impermeable material such as latex or plastic or a latex or plastic laminate. As seen in FIGS. 4 and 6, the open end of the bag liner 30 is releasably attached to the lid closure 26 by placing the open end of the bag liner around the flange 29 of the lid closure and then installing the sealing ring 27 over the assembled bag and flange to resiliently grip the bag liner against the lid. The sealing ring 27 is then clamped between the flange portion 28 of the beverage dispensing tank 19 and the flange 29 of the lid 26 by a releasable latch 31 (FIGS. 5 and 8). Once clamped into place, the liner 30 forms a pressure sealed envelope for containing the liquid beverage.

The beverage dispensing tank 19 may be provided with one or more relief passageways 12A through the side wall 12 to prevent air from being trapped between the exterior of the liner 30 and the interior of the tank as the liner expands to conform to the tank interior.

Figure 7:
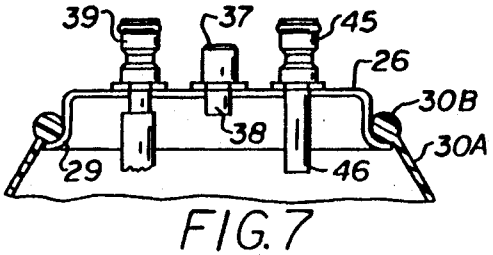
FIG. 7 is a cross section through the releasably locked closure lid showing and alternate liner member attached thereto by means of an integral seal in the open end of the liner.

Alternatively, as shown in FIG. 7, liners 30A may be provided with an integral ring-like sealing surface 30B surrounding the open top end which would fit between the flange 28 of the beverage dispensing tank 19 and the flange 29 of the lid 26. It should also be understood, that the liners may also be pre-filled with a liquid beverage and supplied as a beverage bag. In which case, the open end or upper portion of the liners would be sealed for shipping and storage and then unsealed prior to installation.

Referring now to FIGS. 5 and 8, the releasable latch 31 is formed of a rod bent to form axially aligned pivot shaft portions 32 interconnected by a generally U-shaped portion 33 extending at right angles therefrom. The end of the U-shaped portion 33 is curved downwardly for engagement with the top of the beverage dispensing tank 19 at the rim of the flanged portion 28 so as to angularly position a pair of leg portions 34 depending from the ends of the shaft portions 32 into frictional engagement with the top of the beverage dispensing tank in the latched condition. As best seen in FIG. 8, the ends of the leg portions 34 are provided with resilient end caps 35. The shaft portions 34 are pivotally restrained on top of the lid 26 by a pair of pivot brackets 36. To release the lid 26 from its sealed condition, the U-shaped portion 33 of the latch 31 is pivoted upwardly to angularly displace the leg portions 34 out of engagement with the top of the tank 19. The lid 26 may then be removed from the tank opening 25.

A pressure relief valve 37 connected to the top of the lid 26 has a passageway 38 extending to the underside of the lid for depressurizing the interior of the liner 30 and beverage dispensing tank 19. A quick-release type liquid beverage fill and dispensing check valve 39 is connected to the top of the lid 26 and has a passageway 40 extending to the underside of the lid. A tubular dip tube member 41 conneced to the passageway 40 extends to the bottom of the liner 30.

The dispensing hose 17 is connected to the beverage fill and dispensing valve 39 by a guick-release coupling 42 at one end and its distal end is connected to a selectively operable dispensing valve 43. The dispensing hose 17 has an outer covering 44 of flexible insulating material.

A quick-release type gas fill and recharging check valve 45 is connected to the top of the lid 26 and has a passageway extending to the underside of the lid and connected with a tubular extension 46 which extends a short distance into the top portion of the liner 30. A short hose 47 is connected to the gas fill and recharging valve 45 by a quick-release coupling 48 at one end and its distal end is connected to a recharging manifold assembly 49 which is connected to the pressurized gas supply tank 20 which is carried in the back pack 10. As explained hereinafter, the pressurized gas supply tank 20 carried in the back-pack maintains the liquid beverage under pressure after the beverage dispensing tank 19 is filled and initially charged with gas.

Figure 9:
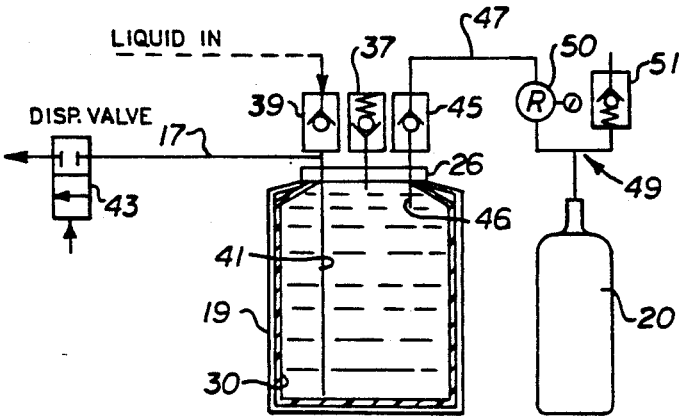
FIG. 9 is a schematic illustration of the pressure and fluid flow path of the portable beverage dispensing system after the beverage dispensing container has been filled and initially charged with gas.

FIG. 9 illustrates schematically the pressure and fluid flow path of the portable beverage dispensing system after the beverage dispensing tank 19 has been filled and initially charged with gas (explained hereinafter). Pressurized gas from the supply tank 20 is supplied to the beverage dispensing tank 19 through the recharging manifold 49 which includes an adjustable pressure regulator 50 and a quick-release type check valve 51. The quick-release check valve 51 is used to refill the pressurized gas supply tank 20 and the pressure regulator 50 maintains the desired gas pressure on the liquid in the tank 19 being dispensed through the selectively operable dispensing valve 43. The liquid beverage is forced up the dip tube 41 and out through the dispensing hose 17 and dispensing valve 43. The pressure relief valve 37 serves as a safety valve and will open should the pressure within the beverage dispensing tank 19 exceed a predetermined level.

FILLING METHOD

Non-carbonated beverages, such as coffee, hot chocolate, etc., are dispensed utilizing compressed air, and carbonated beverages, such as soft drinks, beer, etc., are dispensed utilizing $CO_2$ pressure. It should be understood, that the supply tank 20 may be either a compressed air tank or a $CO_2$ tank, and that a conventional hand pump may be used in place of a compressed air tank to maintain the pressure on non-carbonated beverages.

To fill the beverage dispensing tank 19 with non-carbonated beverages, a liner 30 in a collapsed condition is inserted through the opening 25 at the top of the beverage dispensing tank and the liquid is poured into the liner via a funnel. As the liquid fills the liner, the liner expands to conform to the interior of the beverage dispensing tank. After filling, the open end of the bag liner 30 is releasably attached to the lid closure 26 by placing the open end of the bag liner around the flange 29 of the lid closure and then installing the sealing ring 27 over the assembled bag and flange to resiliently grip the bag liner against the lid. The sealing ring 27 is then clamped between the flange portion 28 of the beverage dispensing tank 19 and the flange 29 of the lid 26 by the releasable latch 31. Once clamped into place, the liner 30 forms a pressure sealed envelope containing the liquid beverage.

Figure 10:
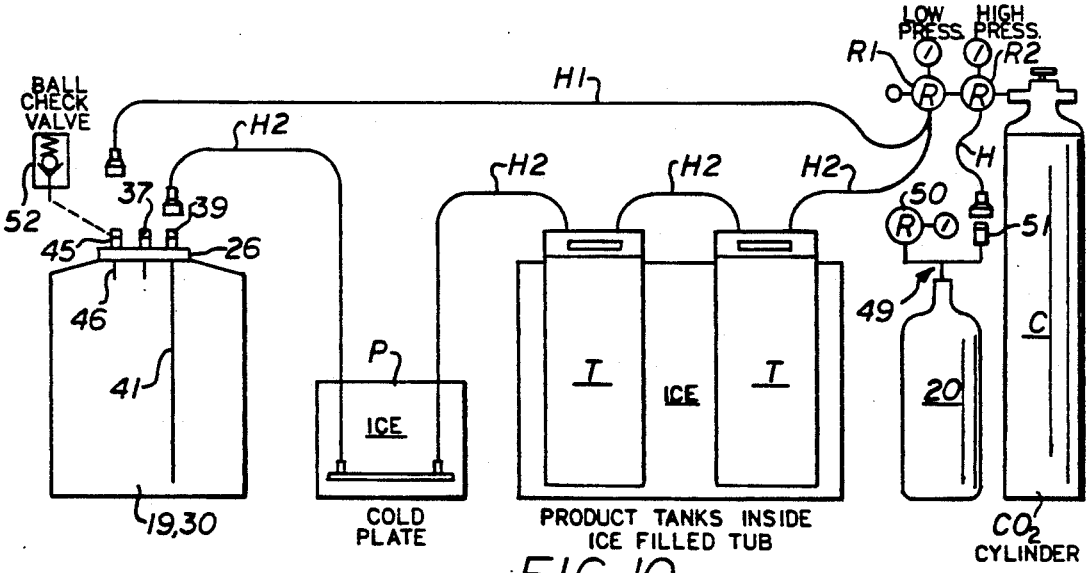
FIG. 10 is a schematic illustration of the pressure and fluid flow path in a back pressure filling method for initially filling the beverage dispensing container and pressurized gas container.

With reference to FIG. 10, a "back pressure filling method" is used to fill the beverage dispensing tank with carbonated beverages. This method maintains the correct carbonation of the beverage and prevents loss of carbonation which results in a "flat" drink. This method also prevents over-carbonation which results in excessive "foaming" when the beverage is dispensed. The correct filling pressure is determined by the temperature of the beverage. The beverage may be chilled to the desired dispensing (serving) temperature prior to or after filling the beverage dispensing tank.

The "back pressure filling method" utilizes a $CO_2$ fill cylinder C with a low pressure regulator R1 and a high pressure regulator R2 connected thereto and a quick-release ball check valve 52. Low pressure regulator R1 is set to between 18–30 psi and has a first H1 and second H2 gas hose connected thereto. High pressure regulator R2 is set to 150 psi and has a single gas hose H connected thereto. In FIG. 10, the pre-mixed beverage (product) tanks T are shown inside an ice filled tub and connected in series with an ice filled cold plate P and the second gas fill hose H2 runs through the cold plate to further chill the liquid.

In the "back pressure filling method", a liner in a collapsed condition is inserted through the opening at the top of the beverage dispensing tank and the open end of the bag liner is releasably attached to the lid closure by placing the open end of the bag liner around the flange of the lid member and then installing the sealing ring over the assembled bag and flange to resiliently grip the bag against the lid, as described previously. The sealing ring is then clamped between the flange portion of the beverage dispensing tank and the flange of the lid by the releasable latch. Once clamped into place, the liner forms a pressure sealed envelope.

The gas fill hose H connected to the high pressure regulator R2 is connected to the quick-release check valve 51 on the manifold 49 of the back pack gas supply tank 20 by a quick release coupling. The back pack supply tank 20 is filled until the "hissing" stops (approximately five seconds) and then the hose H is disconnected. The pressure regulator 50 on the manifold 49 should read between 5 and 10 psi. The pressure regulator 50 is then adjusted to increase the pressure to the desired gauge setting and then locked. The recommended pressure settings for beer is 15–18 psi, 15–20 psi for non-carbonated beverages, 18–22 psi for carbonated beverages, and 15–20 for heated beverages, such as coffee. The back pack gas supply tank 20 is now ready for use.

The first gas fill hose H1 connected to the low pressure regulator R1 is connected to the quick-release gas fill and recharging check valve 45 on the top of the lid 26 of the beverage dispensing tank 19 by a quick release coupling. The beverage dispensing tank 19 is filled until the "hissing" sound stops. This pressurizes the interior of the liner 30 and beverage dispensing tank 19. As the liner is pressurized, the liner expands to conform to the interior of the beverage dispensing tank. Air between the exterior of the liner 30 and the interior of the tank 19 escapes through the passageways 12A in the tank side wall as the liner expands. After the tank 19 is pressurized, the first gas fill hose H1 is disconnected.

A ball check valve 52 is connected to the gas fill and recharging check valve 45 on the top of the lid 26. The second gas fill line H2 connected to the low pressure regulator R1 and to the product tanks T and cold plate P is connected to the quick-release liquid beverage fill and dispensing check valve 39 on the top of the lid 26. The ball check valve 52 will vent the internal pressure in the beverage dispensing tank 19 and allow the liquid beverage to be transferred into the tank (liner) through the fill and discharge check valve 39 and dip tube 41. The ball check valve 52 is in fluid communication with the gas fill and recharging valve 45 and short extension 46 and as the liquid fills the tank 19 (liner 30), and enters the tubular extension 46, the ball check valve 52 will automatically close to stop further transfer of the liquid beverage into the beverage dispensing tank. After the tank 19 (liner 30) is filled with liquid, the ball chack valve 52 is disconnected and then the hose H2 is disconnected. The beverage dispensing tank 19 is now ready for use.

Referring again to FIGS. 3 and 9, the short hose 47 connected to the manifold pressure regulator 50 is connected to the gas fill and recharging check valve 45 on the top of the lid 26. The dispensing hose 17 is then connected to the quick-release liquid beverage fill and dispensing check valve 39 on the top of the lid 26 and the dispensing hose is fed through the aperture 16 in the back pack lid 14. The lid 14 is closed and secured over the top end of the back pack 10 and the back pack is ready for connection to the frame and body harness which is worn by the vendor.

While this invention has been described fully and completely with special emphasis upon a preferred embodiment, it should be understood that within the scope of the appended claims the invention may be practiced otherwise than as specifically described herein.

I claim:

1. A portable liquid beverage dispensing system comprising;

a beverage container having a rigid wall and an access opening at one end thereof surrounded by a peripheral flange dimensioned to accommodate insertion and withdrawal of a flexible liner in a collapsed condition, a flexible thermally insulating and cushioning jacket closely surrounding the exterior of the rigid wall of said beverage container, a releasably locked closure lid removably and sealingly mounted within said beverage container opening and having a peripheral flange configured to engage said container flange and manually moveable lock means thereon to releasably clamp said flanges together and gas filling valve means and liquid filling and dispensing valve means on said lid with respective sealed gas and liquid passages extending through said lid, a removable gas and liquid impermeable flexible liner dimensioned to be inserted into and withdrawn from said beverage container in a collapsed condition to be filled with a liquid and substantially conform to the shape of the interior of said beverage container in an installed liquid filled condition, said liner having an open end surrounded by a seal element releasably engaged in fluid sealing relation between said container flange and said lid flange in the clamped condition to form a fluid pressure sealed envelope for containing a liquid beverage and the respective gas and liquid passages extending through said closure lid being positioned within the interior of the pressure sealed envelope, a pressurized gas container containing gas under pressure operatively connected to said gas filling valve means on said closure lid to effect pressurization of a liquid contained within said liner, a pressure relief valve mounted on said closure lid with a sealed passage extending through said lid in fluid communication with the interior of the pressure sealed envelope for relieving excess pressure in said liner, and a flexible hose having a thermally insulated outer covering operatively connected at one end to said liquid filling and dispensing valve means on said closure lid and a selectively operable liquid dispensing valve at its opposite end for dispensing the pressurized liquid from said liner.

2. The beverage dispensing system according to claim 1 in which said thermally insulating and cushioning jacket surrounding said beverage container rigid wall comprises a thermally insulating foam layer and an outer flexible cover.

3. The beverage dispensing system according to claim 1 in which said flexible hose thermally insulating outer covering comprises a layer of thermally insulating foam surrounded by an outer flexible cover.

4. The beverage dispensing system according to claim 1 in which said seal element is a resilient O-ring seal at the open end of said liner disposed between said flanges for effecting a fluid sealing relation between said flanges and said liner.

5. The beverage dispensing system according to claim 1 in which said seal element is a resilient annular seal integrally formed at the open end of said liner configured to be engaged between said flanges for effecting a fluid sealing relation between said flanges and said liner.

6. The beverage dispensing system according to claim 1 including;

a back pack adapted to be supported on a body harness worn by a vendor and having a central storage compartment, said beverage container and said pressurized gas container are removably received and carried within said central storage compartment, and said flexible hose is movable between a stored position entirely within said central storage compartment and an extended dispensing position extending outwardly from said central storage compartment.

7. A portable beverage dispensing system carried on the body of a person for dispensing beverages comprising;

a back pack adapted to be supported on a body harness worn by a person and having a central storage compartment, a beverage container removably received in said central storage compartment and having a rigid wall surrounded by a flexible thermally insulating and cushioning jacket and an access opening at one end thereof surrounded by a peripheral flange dimensioned to accommodate insertion and withdrawal of a flexible liner in a collapsed condition, a releasably locked closure lid removably and sealingly mounted within said beverage container opening and having a peripheral flange configured to engage said container flange and manually moveable lock means thereon to releasably clamp said flanges together and gas filling valve means and liquid filling and dispensing valve means on said lid with respective sealed gas and liquid passages extending through said lid, a removable gas and liquid impermeable flexible liner dimensioned to be inserted into and withdrawn from said beverage container in a collapsed condition to be filled with a liquid and substantially conform to the shape of the interior of said beverage container in an installed liquid filled condition, said liner having an open end surrounded by a seal element releasably engaged in fluid sealing relation between said container flange and said lid flange in the clamped condition to form a fluid pressure sealed envelope for containing a liquid beverage and the respective gas and liquid passages extending through said closure lid being positioned within the interior of the pressure sealed envelope, a pressurized gas container containing gas under pressure removably received in said central compartment and operatively connected to said gas filling valve means on said closure lid to effect pressurization of a liquid contained within said liner, a pressure relief valve mounted on said closure lid with a sealed passage extending through said lid in fluid communication with the interior of the pressure sealed envelope for relieving excess pressure in said liner, and a flexible hose having a thermally insulated outer covering removably received in said central compartment and operatively connected at one end to said liquid filling and dispensing valve means on said closure lid and a selectively operable liquid dispensing valve at its opposite end for dispensing the pressurized liquid from said liner.

8. The portable beverage dispensing system according to claim 7 in which said liquid dispensing means is movable between a stored position entirely within said central storage compartment and an extended dispensing position extending outwardly from said central storage compartment.

9. The portable beverage dispensing system according to claim 7 in which said thermally insulating and cushioning jacket surrounding said beverage container rigid wall comprises a thermally insulating foam layer and an outer flexible cover.

10. The portable beverage dispensing system according to claim 7 in which said flexible hose thermally insulating outer covering comprises a layer of thermally insulating foam surrounded by an outer flexible cover.

11. The portable beverage dispensing system according to claim 7 in which said seal element is a resilient O-ring seal at the open end of said liner disposed between said flanges for effecting a fluid sealing relation between said flanges and said liner.

12. The portable beverage dispensing system according to claim 7 in which said seal element is a resilient annular seal integrally formed at the open end of said liner configured to be engaged between said flanges for effecting a fluid sealing relation between said flanges and said liner.

13. In a liquid beverage dispensing container having a rigid wall and an access opening at one end thereof surrounded by a peripheral flange, a lid having a corresponding peripheral flange configured to be removably received within the beverage container opening, clamping means operatively connected between the container and lid to engage the container flange and lid flange in a releasably clamped condition, and fittings on the lid for connecting the interior of the container in fluid communication with gas filling means and liquid filling and dispensing means;

a gas and liquid impermeable flexible liner dimensioned to be inserted into and withdrawn from said beverage container in a collapsed condition to be filled with a liquid and substantially conform to the shape of the interior of said beverage container in an installed liquid filled condition, said liner having an open end surrounded by a seal element releasably engaged on said lid flange to maintain said liner thereon during insertion and removal and to become engaged in fluid sealing relation between said container flange and said lid flange in the clamped condition to form a fluid pressure sealed envelope for containing a liquid beverage, whereby said lid and said liner assembly may be inserted and withdrawn from said container as a single unit and said liner in the installed condition filled with a liquid beverage of one type and after depletion of the liquid beverage, said liner may be refilled with a liquid beverage of the same type, or another said lid and said liner assembly may be installed in the same container from which the previous assembly was removed and filled with a liquid beverage of another type without requiring cleaning of said beverage dispensing container when switching from one beverage to another.

* * * * *